US007753096B2

(12) United States Patent
Poeschl et al.

(10) Patent No.: US 7,753,096 B2
(45) Date of Patent: Jul. 13, 2010

(54) FILLING DEVICE FOR CONTAINER FILLING MACHINES

(75) Inventors: Stefan Poeschl, Regensburg (DE); Rupert Meinzinger, Kirchroth (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/317,178

(22) Filed: Dec. 19, 2008

(65) Prior Publication Data

US 2009/0101231 A1 Apr. 23, 2009

Related U.S. Application Data

(63) Continuation of application No. PCT/EP2007/004348, filed on May 16, 2007.

(30) Foreign Application Priority Data

Jun. 24, 2006 (DE) ..... 20 2006 009 923 U

(51) Int. Cl.
*B65B 1/04* (2006.01)

(52) U.S. Cl. ..... 141/372; 141/369; 141/370

(58) Field of Classification Search ..... 141/144–147, 141/369–372, 392
See application file for complete search history.

(56) References Cited

U.S. PATENT DOCUMENTS

| | | | | | |
|---|---|---|---|---|---|
| 2,913,016 | A | * | 11/1959 | Luther | 141/7 |
| 3,048,206 | A | | 8/1962 | Keller et al. | |
| 3,742,989 | A | * | 7/1973 | Campbell et al. | 141/371 |
| 3,841,364 | A | * | 10/1974 | Heckmann et al. | 141/286 |
| 3,934,623 | A | * | 1/1976 | Hays | 141/98 |
| 4,126,163 | A | * | 11/1978 | Hartness et al. | 141/269 |

FOREIGN PATENT DOCUMENTS

| | | |
|---|---|---|
| DE | 872 017 | 3/1953 |
| DE | 12 61 769 | 8/1959 |
| DE | 27 13 562 | 10/1978 |

* cited by examiner

*Primary Examiner*—Timothy L Maust
(74) *Attorney, Agent, or Firm*—Simpson & Simpson, PLLC

(57) ABSTRACT

A filling device for container filling machines including an exchangeable centering socket for a mouth of a container, a bayonet joint for mounting the centering socket to the filling device, and at least one permanent magnet for removably fixing the centering socket in a locked position.

6 Claims, 2 Drawing Sheets

FILLING DEVICE FOR CONTAINER FILLING MACHINES

CROSS REFERENCE TO RELATED APPLICATIONS

This application is filed under 35 U.S.C. §120 and §365(c) as a continuation of International Patent Application PCT/EP2007/004348, filed May 16, 2007, which application claims priority from German Utility Model No. 20 2006 009 923.9, filed Jun. 24, 2006, which applications are incorporated herein by reference in their entireties.

FIELD OF THE INVENTION

The invention relates to a filling device for container filling machines.

BACKGROUND OF THE INVENTION

In container filling machines, a frequent exchange of the centering socket is necessary, when the socket, for example, experiences deterioration or when the container filling machine is changed over to fill a different type of container. In order to conduct transaction rapidly and without difficulty, it has already been proposed to detachable mount the centering socket by means of a manually operated snap ring at the appropriate filling device (DE-AS 1 261 769). This known design is relatively bulky and spacious and does not comply with stricter microbiological requirements.

SUMMARY OF THE INVENTION

Therefore, the object of the present invention is to improve the known design by simple means that meets higher microbiological standards.

The current invention broadly comprises a filling device for container filling machines including an exchangeable centering socket for a mouth of a container, a bayonet joint for mounting the centering socket to the filling device, and at least one permanent magnet for removably fixing the centering socket in a locked position. In one embodiment, the filling device further comprises at least two pins, each with a broadened top, and positioned at the centering socket, and at least two keyhole-shaped recesses in the filling device, wherein the recesses are operatively arranged to receive and engage with the two pins.

In one embodiment, the pins are positioned at an upper side of the centering socket in such a way that the pins are generally parallel to a centerline of the centering socket. In another embodiment, the recesses are positioned proximate to a filler neck of the filling device at an underside of the filling device. In yet another embodiment, the least one permanent magnets comprises a first permanent magnet and a second permanent magnet, wherein the first permanent magnet is positioned at the filling device and the second permanent magnet is positioned at the centering socket, and the first and second permanent magnets are operatively arranged to attract each other. In another embodiment, the first and second permanent magnets are positioned so that they engage in a flushed relation between an underside of the filling device and an upper side of the centering socket, respectively.

In one embodiment, at least two pins are provided, wherein each has broadened top. The pins are positioned at the circular centering socket and at least two keyhole-shaped recesses are provided at the filling device, whereby the recesses interact with the two pins. The pins are positioned at the upper side of the centering socket in such a way that they are parallel to a centerline of the centering socket. The recesses are positioned sidewise next to a filler neck at the underside of the filling device.

The at least two interacting permanent magnets are positioned at the filling device and the centering socket. The permanent magnets are positioned in a flushed way at the underside of the filling device and at the upper side of the centering socket.

The fastener of the centering socket according to the present invention, which is secured by means of a magnetic bayonet joint, enables a compact, smooth design and is therefore also suitable for usage in sterile container filling machines and when installing space is cramped.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
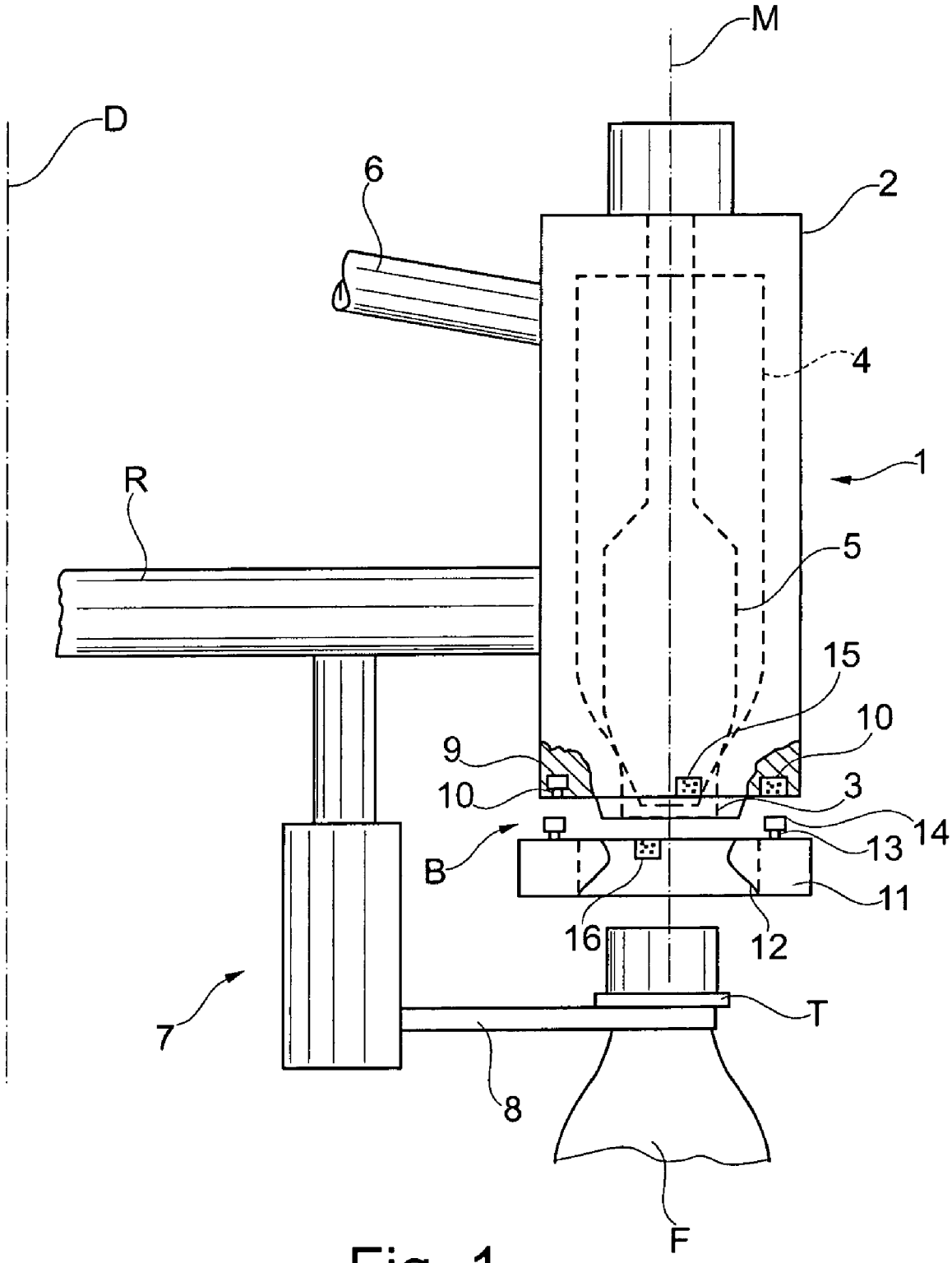
FIG. 1 shows a side view of a current invention filling device and of its associated centering socket separated from the filling device.
Figure 2:
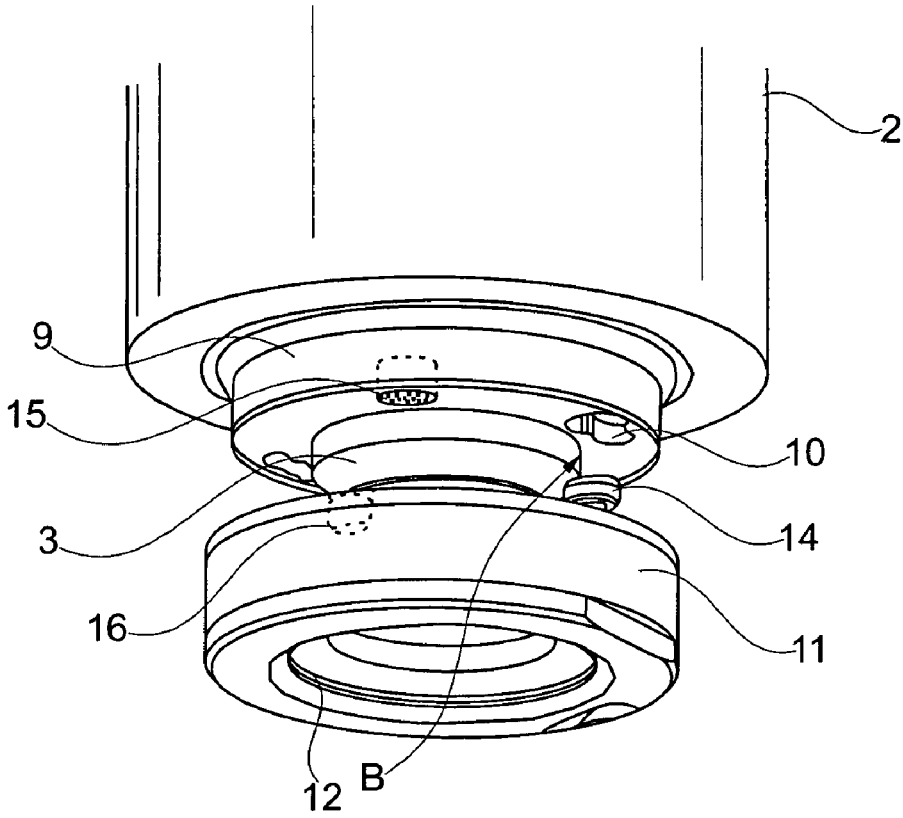
FIG. 2 shows a perspective view of the filling device according to FIG. 1; and, FIG. 3 shows a perspective view of the filling device according to FIG. 1 with attached centering socket in a locked position.
Figure 3:
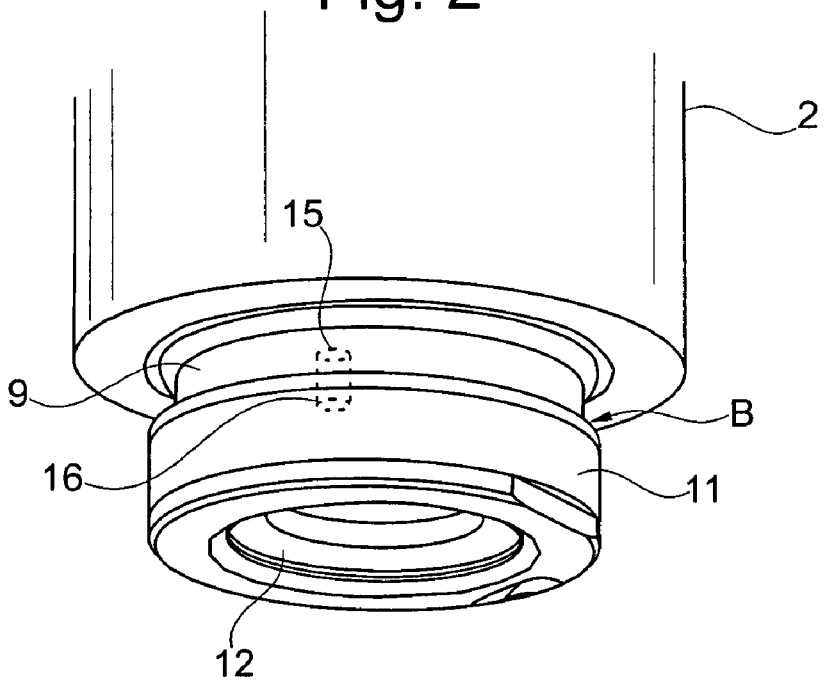

Filling device 1 according to FIGS. 1 to 3 is positioned together with a plurality of identical filling devices at the circumference of rotor R on a container filling machine, whereby rotor R rotates around vertical axis D. It should be appreciated that only one filling device is shown in the drawings, but that a container filling machine would typically include multiple identical filling devices for faster filling of large numbers of containers. Filling device 1 is provided with housing 2, which includes rotation-symmetric filler neck 3 positioned at a bottom end of the housing, from which liquid to be bottled is dispensed, for example still mineral water. Of course, any other desired liquid could be dispensed from the filling device into a suitable container. Inside housing 2, liquid channel 4 with controllable liquid valve 5 is formed, wherein liquid channel 4 is connected via pipe 6 with a not shown liquid container.

Each filling device 1 is provided with its own lifting organ 7, whereby lifting organ 7 is also positioned at rotor R and is provided with container holder 8. Container holder 8 has a U-shaped opening wherein PET bottle F to be filled can be inserted in such a way that carrier ring T of PET bottle F is supported by container holder 8. It should of course be understood that other styles and materials of bottles known in the art could be used to substitute PET bottle F.

At the bottom end of housing 2, ring-shaped boss 9 is concentrically positioned to filler neck 3. Two keyhole-like recesses 10 are formed in this boss in such a way that they are shifted by 180° and open to the bottom. On one side, keyhole-like recesses 10 are provided with a circular opening followed by a narrower portion. Close to each recess 10, permanent magnet 15 is mounted in boss 9 which is aligned with the bottom front side of boss 9 in a flushed way.

Ring-shaped centering socket 11 is provided with each filling device 1 in order to center the mouth of bottle F, hanging in container holder 8, with regard to filler neck 3. Ring-shaped centering socket 11 is provided with a cone-shaped center hole whose diameter is adjusted to the mouth of bottle F to be filled.

At the upper part of centering socket 11, two pins 13 each with broadened top 14 are positioned in a shifted way by 180° and running parallel to centerline M of centering socket 11. Diameter of tops 14 is designed in such a way that that they can be inserted in a vertical direction from the bottom into the openings of recesses 10. The diameter of pins 13 is designed in such a way that pins 13 can be swung into the narrowed part of recesses 10 whereby tops 14 are being held by the narrowed part of recesses 10. Thus, bayonet joint B is provided which can be locked and unlocked by a simple lift-and-turn movement.

At the upper side of centering socket 11, two permanent magnets 16 are positioned in a shifted way by 180° in order to fix centering socket 11 in the locked position of bayonet joint B, whereby permanent magnets 16 flush with the upper front side of centering socket 11. These permanent magnets 16 interact with two permanent magnets 15, which are also shifted by 180°, in boss 9. Their angle position is adjusted in such a way that they flush with each other when centering socket 11 takes on its locked position, as shown in FIG. 3. The poles of permanent magnets 15, 16 are positioned in such a way that, in this position, a maximal attraction of the permanent magnets is provided both in boss 9 and in centering socket 11. A stable fixation of centering socket 11 in its operating position results from this attraction so that autonomous loosening is absolutely reliably prevented during operation. Simultaneously, possible tolerance is being balanced by the attraction of permanent magnets 15, 16 whereby centering socket 11 takes on a position without backlash in locked state.

In the preferred embodiment, centering socket 11 can be slightly twisted in clockwise direction in order to release bayonet joint B until tops 14 stand in the openings of recesses 10. The strength of permanent magnets 15, 16 is so that the release can be carried out manually. Afterwards, centering socket 11 can be removed from under filling device 1. The adjustment of centering socket 11 at filling device 1 is effected with a reciprocal course of movement.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A filling device for container filling machines comprising:

an exchangeable centering socket for a mouth of a container;

a bayonet joint for mounting said centering socket to said filling device; and at least one permanent magnet for removably fixing said centering socket in a locked position;

wherein said at least one permanent magnet comprises a first permanent magnet and a second permanent magnet, wherein said first permanent magnet is positioned at said filling device and said second permanent magnet is positioned at said centering socket, and said first and second permanent magnets are operatively arranged to attract each other.

2. The filling device of claim 1, further comprising:

at least two pins, each with a broadened top, and positioned at said centering socket; and, at least two keyhole-shaped recesses in said filling device, wherein said recesses are operatively arranged to receive and engage with said two pins.

3. The filling device of claim 2, wherein said pins are positioned at an upper side of said centering socket in such a way that said pins are generally parallel to a centerline of said centering socket.

4. The filling device of claim 2, wherein said recesses are positioned proximate to a filler neck of said filling device at an underside of said filling device.

5. The filling device of claim 1, wherein said first and second permanent magnets are positioned so that they engage in a flushed relation between an underside of said filling device and an upper side of said centering socket, respectively.

6. A filing device comprising:

an exchangeable centering socket for a mouth of a container;

a bayonet joint for mounting said centering socket to said filling device;

a first permanent magnet and a second permanent magnet for removably fixing said centering socket in a locked position, wherein said first permanent magnet is positioned at said filling device and said second permanent magnet is positioned at said centering socket, and said first and second permanent magnets are operatively arranged to attract each other, and wherein said first and second permanent magnets are positioned so that they engage in a flushed relation between an underside of said filling device and an upper side of said centering socket, respectively;

at least two pins, each with a broadened top, and positioned at said centering socket, wherein said pins are positioned at the upper side of said centering socket in such a way that said pins are generally parallel to a centerline of said centering socket; and, at least two keyhole-shaped recesses in said filling device, wherein said recesses are operatively arranged to receive and engage with said two pins, wherein said recesses are positioned proximate to a filler neck of said filling device at said underside of said filling device.

* * * * *